United States Patent [19]

Carey

[11] 4,157,853

[45] Jun. 12, 1979

[54] CLOSURE MECHANISM

[75] Inventor: Lester G. Carey, Anderson, Ind.

[73] Assignee: General Motors Corporation, Detroit, Mich.

[21] Appl. No.: 863,052

[22] Filed: Dec. 21, 1977

[51] Int. Cl.[2] ..... A47B 67/02; A47F 5/08

[52] U.S. Cl. ..... 312/246; 312/242; 312/248; 131/242; 220/337

[58] Field of Search ..... 312/246, 242, 248, 319; 131/242; 206/263; 220/337

[56] References Cited

U.S. PATENT DOCUMENTS

| | | | |
|---|---|---|---|
| 1,322,807 | 11/1919 | Metcalf | 206/263 |
| 1,697,074 | 1/1929 | Lorentzen | 220/337 |
| 2,505,324 | 4/1950 | Hendricks | 312/242 |
| 2,626,615 | 1/1953 | Buroker | 131/242 |
| 3,572,871 | 3/1971 | Bonnaud | 312/248 |
| 3,601,464 | 8/1971 | Boer | 312/246 |

FOREIGN PATENT DOCUMENTS

| | | | |
|---|---|---|---|
| 879764 | 10/1961 | United Kingdom | 312/242 |

*Primary Examiner*—Victor N. Sakran
*Attorney, Agent, or Firm*—Donald F. Scherer

[57] ABSTRACT

The drawings disclose a closure mechanism for an ash-tray and the like, including a pivotal cover member and a "U" shaped leaf spring, the cover member having detent projections formed on a portion thereof for co-operation with the spring. The spring exerts a force on the detent projections to retain the cover member in its closed position. The detent projections force the spring outwardly while the cover member is pivoted through a predetermined angle until the detent projections are pivoted over-center, after which the spring retains the cover member in its open position.

2 Claims, 3 Drawing Figures

CLOSURE MECHANISM

The invention relates generally to closure mechanisms and, more specifically, to such closure mechanisms for ashtrays and the like.

A general object of the invention is to provide an improved closure mechanism including detent and leaf spring means for maintaining a cover member in its closed and open positions.

Another object of the invention is to provide a closure mechanism including a three sided cover member with one of the sides serving as a door, pivotal means formed on the side opposite the door pivotally connected at the ends thereof to suitable support walls and adapted to being manually pivoted through a predetermined angle corresponding to closed and open positions for the door, at least one detent projection formed on the pivotal means, a generally "U" shaped leaf spring including oppositely disposed side portions and a bottom portion, the side portions being mounted on respective support walls, and the bottom portions exerting a force against the detent projection to thereby retain the door in its closed position, and the detent projections serving to force the bottom section of the leaf spring outwardly while the cover member is pivoted through the predetermined angle until the detent projections are pivoted over-center with respect to the adjacent spring, the latter thereafter continuing to exert sufficient force against the detent projection to retain the door of the cover member in its open position.

These and other objects and advantages will become more apparent when reference is made to the following description and accompanying drawings, wherein.

Figure 1:
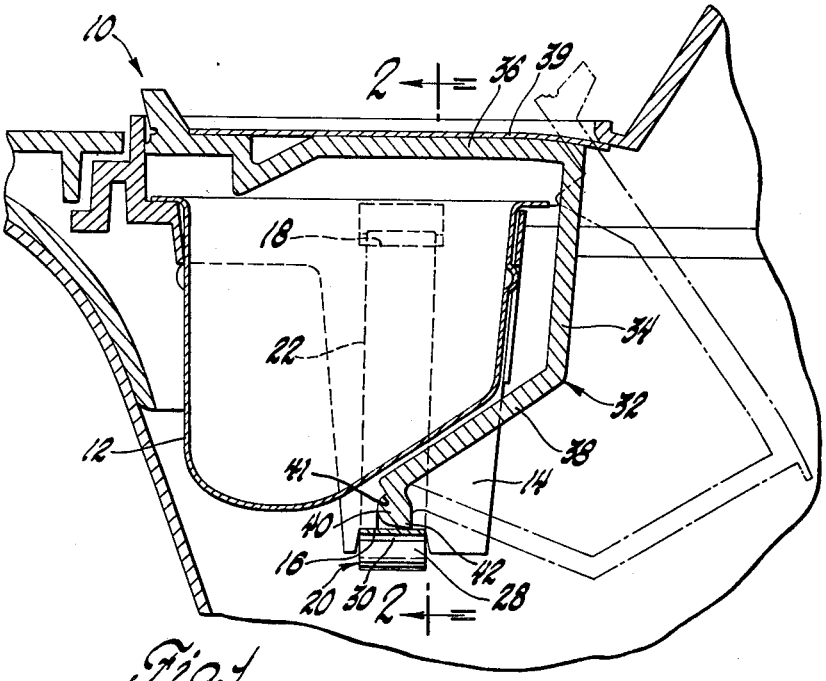
FIG. 1 is a side elevational view of a closure mechanism embodying the invention.
Figure 2:
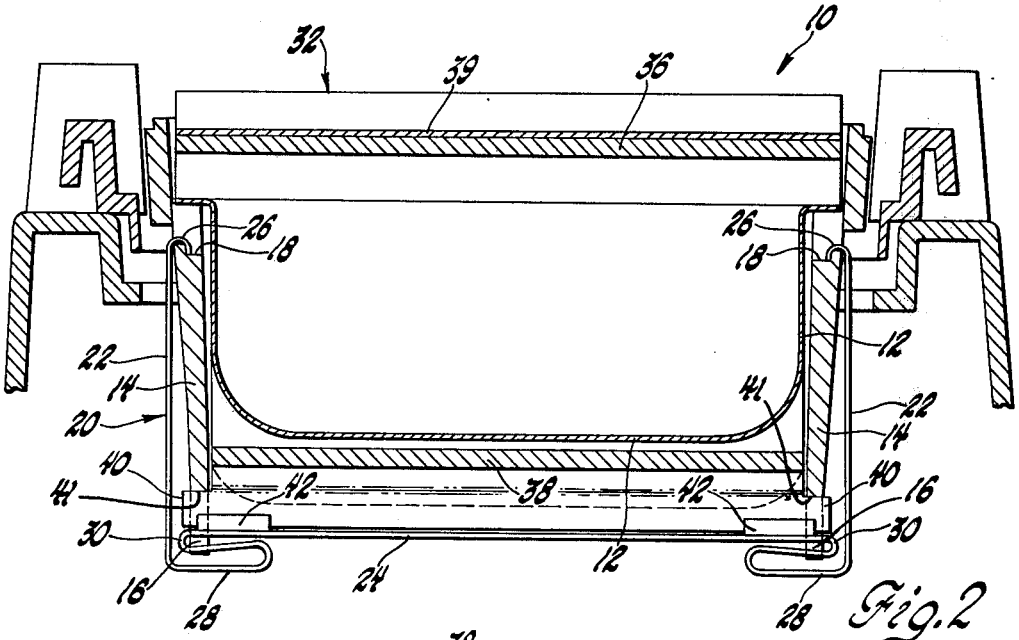
FIG. 2 is a cross-sectional view taken along the plane of the line 2—2 of FIG. 1, and looking in the direction of the arrows.

Referring now to the drawings in greater detail, FIGS. 1 and 2 illustrate a closure mechanism 10 for an ashtray 12, and the like, seated on the top surface of a pair of oppositely disposed connector or support walls 14, each having a notch 16 formed in the lower free end thereof and a groove or pocket 18 (FIG. 2) formed adjacent the top surface thereof.

A generally "U" shaped leaf spring 20 includes oppositely disposed side portions 22 and a bottom portion 24. An inwardly bent end portion 26 is formed on the upper end of each side portion 22, adaptable to being mounted in each pocket 18. As shown in FIG. 2, a generally "S" shaped connector portion 28 integrally interconnects the lower end of each side portion 22 and the adjacent end of the bottom portion 24. The upper loop 30 of each "S" shaped connector portion 28, which is integrally formed with the bottom portion 24, is mounted in the adjacent notch 16 in the connector wall 14.

A three-sided cover member 32 includes an end wall 34 and oppositely disposed side walls 36 and 38, with the side wall 36 serving as a door. A cosmetic layer 39 may be mounted on the door 36 to match the surrounding exposed surfaces. A pivotal member 40 is formed adjacent the free end of the side wall 38 and pivotally mounted at the ends thereof in notches 41 formed above the notches 16 in the support walls 14. The associated door 36 is thus adaptable to being manually pivoted through a predetermined angle from closed to open positions and is retained in place in the notches 41 by the force of the spring 20, as will be explained.

A detent projection 42 is formed on the pivotal member 40 adjacent each end portion thereof and extended along a plane through the axis of the pivotal member in a predetermined angular relationship with the plane of the door 36. As may be noted in FIG. 2, the detent projections 42 are positioned adjacent the respective upper loops 30 of the leaf spring connector portion 28, abutting against the ends of the bottom spring portion 24.

Figure 3:
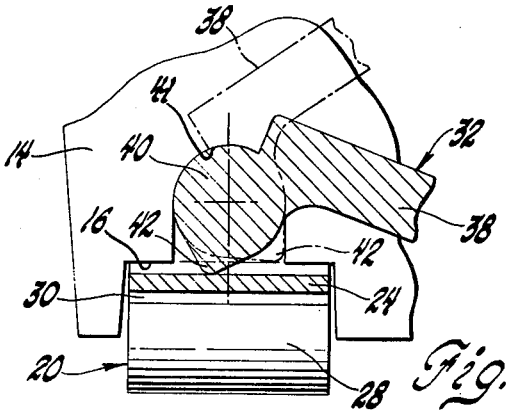
FIG. 3 is an enlarged fragmentary cross-sectional view of a portion of the FIG. 1 structure showing two operational positions of the invention.

As indicated in FIGS. 1 and 3, the integral spring loop 30 and end of the bottom portion 24 exerts a force against the adjacent detent projection 42 in each of the respective open and closed positions of the door 36, the closed position being shown in FIG. 1 and in phantom in FIG. 3, and the open position being represented in FIG. 3. The spring force thus exerted against the detent projections 42 is sufficient to retain the door 36 in each of its open and closed positions, as well as to retain the cover member 32 in its assembled condition on the support walls 14 by virtue of retaining the pivotal member 40 in the slots 41.

It is apparent that, as the cover member 32 is pivoted in either direction through the predetermined angle between its open and closed positions, the detent projections 42 force the loop portions 30 and the bottom portion 24 of the leaf spring 20 outwardly, until the detent projections are pivoted over-center with respect to the adjacent spring surfaces, after which the door 36 is snapped into either the open or closed positions under the force of the spring.

It should also be apparent that the precise angle of the detent projections 42 may be selected with respect to the plane of the door 36 so as to vary the angle through which the door moves between its open and closed positions.

While but one embodiment of the invention has been shown and described, other modifications thereof are possible.

It is claimed:

1. A closure mechanism for an ashtray and the like, comprising a pair of oppositely disposed connector walls, a notch formed in the free end of each of said connector walls, a three sided cover member having an end wall and oppositely disposed side walls, with one of said side walls serving as a door portion, pivotal means formed on the other of said side walls pivotally connected at the ends thereof to said connector walls and adapted to being manually pivoted through a predetermined angle from a first position to a second position corresponding to closed and open positions of said door portion, a detent projection formed on said pivotal means adjacent each end portion thereof and extending along a predetermined plane through the axis of said pivotal means, a generally "U" shaped leaf spring including oppositely disposed side portions and a bottom portion, mounting means formed on the free end of each of said side portions for mounting on respective connector walls, and an "S" shaped connector portion integrally interconnecting the other end of each of said side portions and the adjacent end of said bottom portion, with the loop of each connector portion which is integrally connected to said bottom portion being mounted in said adjacent notch in said connector wall and exerting a force against said adjacent detent projection to thereby retain said door portion of said cover member in its closed position, and said detent projections forcing said loop and said bottom section outwardly while said cover member is pivoted through said predetermined angle until said detent projections are pivoted over-center with respect to said adjacent spring loops to thereby retain said door portion of said cover member in its open position by the force of said spring portions against said detent projections.

2. A closure mechanism comprising a pair of oppositely disposed support walls, dual notch means formed in one end of each of said support walls, a groove formed in the other end of each of said support walls, a three-sided cover member having an end wall and oppositely disposed side walls, with one of said side walls serving as a door portion, pivotal means formed on the other of said side walls pivotally mounted at the ends thereof in a first portion of said dual notch means and adapted to being manually pivoted through a predetermined angle from a first position to a second position corresponding to closed and open positions of said door portion, a detent projection formed on said pivotal means adjacent each end portion thereof and extending along a predetermined plane through the axis of said pivotal means, generally "U" shaped leap spring including oppositely disposed side portions and a bottom portion, means formed on the free end of each of said side portions for mounting in said grooves on respective support walls, and a connector portion integrally interconnecting the other end of each of said side portions and the adjacent end of said bottom portion, said connector portions being mounted in a second portion of said dual notch means and exerting a force against said adjacent detent projections to thereby retain said cover member in its assembled condition and to retain said door portion of said cover member in its closed position, and said detent projections forcing said spring bottom portion outwardly while said cover member is pivoted through said predetermined angle until said detent projections are pivoted over-center with respect to said adjacent spring bottom portion to thereby cause said door portion of said cover member to be retained in its open position by the force of said spring bottom portions against said detent projections.

* * * * *